United States Patent [19]

Fujimoto et al.

[11] Patent Number: 4,915,081

[45] Date of Patent: Apr. 10, 1990

[54] METHOD OF DETERMINING ACTIVATION OF EXHAUST GAS INGREDIENT-CONCENTRATION SENSORS FOR INTERNAL COMBUSTION ENGINES

[75] Inventors: Sachito Fujimoto; Shunji Takahashi, both of Wako, Japan

[73] Assignee: Honda Giken Kogyo K.K., Tokyo, Japan

[21] Appl. No.: 324,221

[22] Filed: Mar. 15, 1989

[30] Foreign Application Priority Data

Mar. 18, 1988 [JP] Japan ..... 63-65324

[51] Int. Cl.[4] ..... F02D 41/14

[52] U.S. Cl. ..... 123/489; 123/440

[58] Field of Search ..... 123/440, 489, 493

[56] References Cited

U.S. PATENT DOCUMENTS

| | | | |
|---|---|---|---|
| 4,434,764 | 3/1984 | Hasegawa et al. | 123/489 |
| 4,485,786 | 12/1984 | Kashimura | 123/440 |
| 4,502,443 | 3/1985 | Hasegawa et al. | 123/489 |
| 4,566,419 | 1/1986 | Ninomiya et al. | 123/489 |
| 4,723,521 | 2/1988 | Mieno et al. | 123/489 |
| 4,751,909 | 6/1988 | Otobe | 123/489 |

FOREIGN PATENT DOCUMENTS

| | | | |
|---|---|---|---|
| 3628707 | 2/1988 | Fed. Rep. of Germany | 123/440 |
| 0005417 | 1/1980 | Japan | 123/440 |
| 0008246 | 1/1983 | Japan | 123/440 |
| 0217733 | 12/1983 | Japan | 123/440 |
| 0015651 | 1/1984 | Japan | 123/440 |

OTHER PUBLICATIONS

Japanese Provisional Patent Publication (Kokai) No. 62-162955, 7/18/1987.

*Primary Examiner*—Tony M. Argenbright
*Assistant Examiner*—Robert Mates
*Attorney, Agent, or Firm*—Arthur L. Lessler

[57] ABSTRACT

A method of determining the activation of an exhaust gas ingredient-concentration sensor for use in an internal combustion engine. The air-fuel ratio of a mixture is controlled in a feedback manner by the use of a coefficient varying with an output of the sensor during engine operation in an air-fuel ratio feedback control region. The activation of the sensor is determined based on the output of the sensor. When the engine has shifted from the air-fuel ratio feedback control region to a predetermined decelerating region, calculated is an average value of values of the coefficient obtained by the feedback control immediately before the shifting. The air-fuel ratio of the mixture is leaned by the use of the average value thus calculated. It is determined whether or not the sensor is activated when the air-fuel ratio has thus been leaned.

9 Claims, 8 Drawing Sheets

FUEL INJECTION VALVES
6
INTERNAL COMBUSTION ENGINE
1
Ne
11
Tw
10
THREE-WAY CATALYST
14
13
O2
15
16
VH
5
5a
5b
5c
5d
INPUT CIRCUIT
CPU
MEMORY MEANS
OUTPUT CIRCUIT
ECU
TA
9
2
7
PBA
8
3
3'
θTH
4

| FIG. 2A | FIG. 2B |
|---|---|

| FIG. 5A | FIG. 5B |
|---|---|

METHOD OF DETERMINING ACTIVATION OF EXHAUST GAS INGREDIENT-CONCENTRATION SENSORS FOR INTERNAL COMBUSTION ENGINES

BACKGROUND OF THE INVENTION

The present invention relates to a method of determining activation of exhaust gas ingredient-concentration sensors adapted for use in controlling the air-fuel ratio of a mixture supplied to an internal combustion engine, and more particularly to a method of this kind, which utilizes output from the sensor for determining the activation of same.

Exhaust gas ingredient-concentration sensors, for example, oxygen-concentration ($O_2$) sensors in general can produce proper output voltages exactly commensurate with the concentration of oxygen contained in exhaust gases emitted from an internal combustion engine only while the $O_2$ sensor is in an activated state. The output voltage is excessively high while the sensor is in an inactivated state. While the $O_2$ sensor is activated, it supplies an output voltage equal to a reference voltage $V_{REF}$ when the air-fuel ratio of the mixture assumes a stoichiometric ratio, whereas it supplies an output voltage higher than the reference voltage $V_{REF}$ when the air-fuel ratio is richer than the stoichiometric ratio, and an output voltage lower than the reference voltage $V_{REF}$ when the air-fuel ratio is leaner than the stoichiometric ratio.

There is known a method of determining the activation of an $O_2$ sensor, which utilizes the above-mentioned output voltage characteristic of the $O_2$ sensor in such a manner that it is determined that the $O_2$ sensor is in an activated state when the output voltage of the $O_2$ sensor is lower than a predetermined value $V_{X1}$ during a predetermined decelerating condition of the engine in which the air-fuel ratio of the mixture supplied to the engine (hereinafter merely referred to as "the air-fuel ratio") is to be controlled to a leaner value than the stoichiometric ratio.

Another activation determining method has been proposed, e.g., from Japanese Provisional Patent Publication (Kokai) No. 62-162955, which is improved over the above known method such that it is able to always determine whether or not the $O_2$ sensor is activated, irrespective of values of the air-fuel ratio, by supplementing secondary air into the exhaust pipe at an upstream of the $O_2$ sensor to lean the exhaust gases supplied to the $O_2$ sensor, during engine operation in which the air-fuel ratio is to be controlled to a richer value than the stoichiometric ratio, and then effecting determination of activation of the $O_2$ sensor.

These known methods, however, had the disadvantage that accurate determination of activation of the $O_2$ sensor is impossible to effect during deceleration of the engine. To be specific, in the case where the above-mentioned predetermined value $V_{X1}$ is set at a value lower than the reference voltage $V_{REF}$ corresponding to the stoichiometric ratio, accurate determination of the $O_2$ sensor activation is impossible to effect unless the actual air-fuel ratio is positively leaned. However, in the known methods, leaning of the air-fuel ratio is carried out by multiplying a basic value of a fuel supply amount, which has been read from a table of basic values previously set for various operating conditions of the engine, by a mixture-leaning coefficient which has a fixed value. Therefore, in the case where a basic value is read, which gives a richer air-fuel ratio than a theoretically proper value due to manufacturing variations between individual control systems or parameter detecting systems, aging in these systems, etc., it is impossible to positively lean the air-fuel ratio by correcting the read basic value by the mixture-leaning coefficient, thereby failing to effect accurate determination of the activation of the $O_2$ sensor. Further, when the engine shifts into a decelerating condition, fuel adhering to an inner wall of the intake pipe is entrained into engine cylinders together with fuel being normally supplied through a fuel supply system, e.g., fuel injection valves so that there temporarily occurs enrichment of the air-fuel ratio. This also makes it impossible to effect accurate determination of the activation of the $O_2$ sensor.

SUMMARY OF THE INVENTION

It is the object of the invention to provide a method of determining activation of an exhaust gas ingredient-concentration sensor adapted for use in internal combustion engines which is capable of leaning the actual air-fuel ratio in accordance with air-fuel ratio characteristics of individual engines to thereby ensure accurate determination of the activation of the sensor.

To attain the above object, the present invention provides a method of determining the activation of an exaust gas ingredient-concentration sensor for use in an internal combustion engine having an exhaust system in which the sensor is arranged, wherein the air-fuel ratio of a mixture being supplied to the engine is controlled in a feedback manner by the use of a coefficient varying with an output of the sensor during operation of the engine in an air-fuel ratio feedback control region, and the activation of the sensor is determined based on the output of the sensor.

The method according to the invention is characterized by comprising the steps of:

(1) determining whether or not the engine has shifted from the air-fuel ratio feedback control region of a predetermined decelerating region;

(2) when it is determined that the engine has shifted from the air-fuel ratio feedback control region to the predetermined decelerating region, calculating an average value of values of the coefficient obtained by the feedback control immediately before the shifting;

(3) leaning the air-fuel ratio of the mixture by the use of the average value thus calculated; and (4) determining whether or not the sensor is activated when the air-fuel ratio has thus been leaned.

Preferably, the predetermined decelerating region may include a mixture-leaning region and/or a fuel-cut region.

More preferably, the step (2) may comprise holding a value of the coefficient obtained by the feedback control immediately before the shifting for a predetermined time period after the shifting, and calculating the average value based on the held value.

Further, the step (3) may comprise leaning the mixture by the use of the average value of the coefficient together with a second coefficient exclusive for leaning the mixture.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
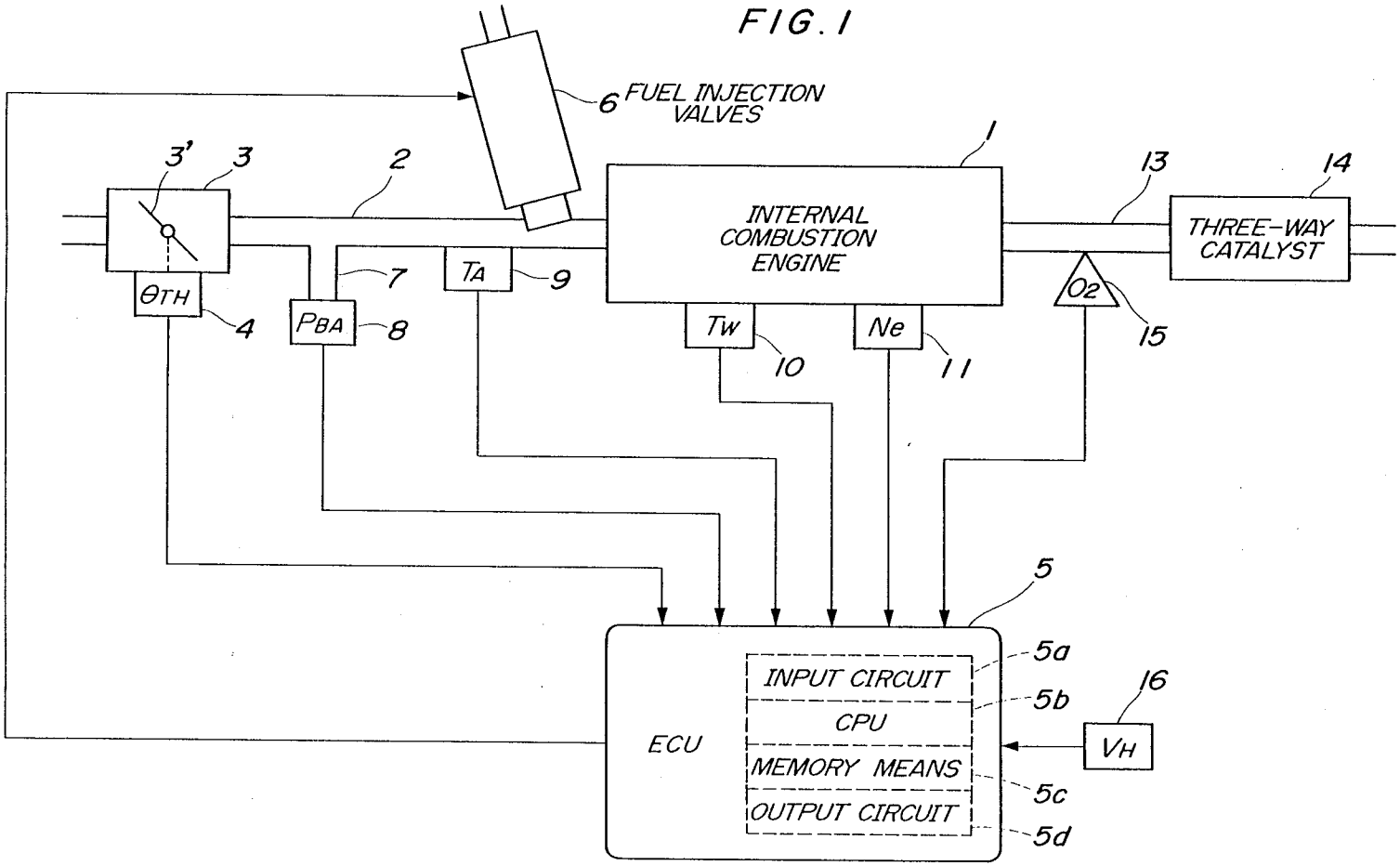
FIG. 1 is a block diagram showing the overall arrangement of a fuel supply control system for an internal combustion engine to which is applied the method according to the invention.

Referring first to FIG. 1, there is illustrated the whole arrangement of a fuel supply control system for an internal combustion engine, to which the method according to the invention is applied. In the figure, reference numeral 1 designates an internal combustion engine having an intake pipe 2 connected thereto. In the intake pipe 2 is arranged a throttle body 3 internally provided with a throttle valve 3'. A throttle valve opening ($\theta_{TH}$) sensor 4 is connected to the throttle valve 3' to supply an electrical signal indicative of the sensed opening $\theta_{TH}$ of the throttle valve 3' to an electronic control unit (hereinafter referred to as "the ECU") 5.

Fuel injection valves 6 are provided in the intake pipe 2 each at a location upstream of an intake valve, not shown, between the engine 1 and the throttle body 3 to supply fuel to the corresponding cylinder of the engine 1. The fuel injection valves 6 are each connected to a fuel pump, not shown, to be supplied with fuel, and electrocally, connected to the ECU 5 to be supplied with a driving signal therefrom, by which the valve opening time period is controlled.

An absolute pressure ($P_{BA}$) sensor 8 for detecting absolute pressure $P_{BA}$ within the intake pipe 2 is connected through a pipe 7 to the interior of the intake pipe 2 at a location slightly downstream of the throttle body 3. The $p_{BA}$ sensor 8 gives an electrical signal representing the detected absolute pressure $P_{BA}$ to the ECU 5. An intake air temperature ($T_A$) sensor 9 for detecting intake air temperature $T_A$ within the intake pipe 2 is connected to the interior of the intake pipe 2 at a location downstream of the $P_{BA}$ sensor 8. The $T_A$ sensor 9 gives an electrical signal representing the detected intake air temperature $T_A$ to the ECU 5.

An engine coolant temperature ($T_W$) sensor 10, which may be formed of a thermistor or the like, is mounted in the cylinder block of the engine 1 in a manner embedded in the peripheral wall of an engine cylinder having its interior filled with coolant, detects engine coolant temperature $T_W$ and supplies an electrical signal indicative of the detected engine coolant temperature to the ECU 5. An engine rotational speed (Ne) sensor 11 is arranged in facing relation to a camshaft, not shown, of the engine 1 or a crankshaft of same, not shown. The Ne sensor 11 is adapted to generate a pulse of a top-dead-center position (TDC) signal (hereinafter referred to as "the TDC signal") at one of predetermined crank angles of the engine whenever the engine crankshaft rotates through 180 degrees. The pulse generated by the Ne sensor 11 is supplied to the ECU 5.

A three-way catalyst 14 is arranged in an exhaust pipe 13 extending from the cylinder block of the engine 1 for purifying ingredients HC, CO, and NOx contained in the exhaust gases. An $O_2$ sensor 15 as the exhaust gas ingredient-concentration sensor is inserted in the exhaust pipe 13 at a location upstream of the three-way catalyst 14 for detecting the concentration of oxygen ($O_2$) in the exhaust gases as the exhaust gas ingredient and supplying an electrical signal indicative of the detected oxygen concentration to the ECU 5. Further connected to the ECU 5 is a vehicle speed ($V_H$) sensor 16 for detecting the speed of a vehicle in which the engine is installed, for supplying an electrical signal indicative of the detected vehicle speed to the ECU 5.

The ECU 5 comprises an input circuit 5*a* which shapes the respective waveforms of input signals received from some of the sensors, adjusts the respective voltages of signals from other or analog-output sensors to a predetermined level and converts the respective analog values of the voltage-adjusted input signals to corresponding digital values, a central processing unit (hereinafter referred to as "the CPU") 5*b*, a memory unit 5*c* which stores programs to be executed by the CPU 5*b* and is for storing results of operations executed by the CPU 5*b*, and an output circuit 5*d* which gives driving signals to the fuel injection valves 6.

The CPU 5*b* operates in response to various engine operating parameter signals stated above, to determine engine operating conditions in a feedback control region or various particular control regions other than the feedback control region (hereinafter referred to as "the open-loop control regions"), and then to calculate the fuel injection period $T_{OUT}$ for which each fuel injection valve 6 should be opened in accordance with the determined operating conditions or regions of the engine and in synchronism with generation of pulses of the TDC signal, by the use of the following equation (1).

$$T_{OUTM} = T_i \times K_{O2} \times K_{LS} \times K_1 + K_2 \quad (1)$$

where Ti represents a basic value of the valve opening period for the fuel injection valve 6, which is determined from the engine rotatinal speed Ne and the intake pipe absolute pressure $P_{BA}$, for example. $K_{O2}$ represents an air-fuel ratio correction coefficient (hereinafter merely referred to as "the correction coefficient"), the value of which is calculated in response to the actual oxygen concentration in the exhaust gases by means of steps of a subroutine shown in FIG. 5 when the engine 1 is in the feedback control region, and set by means of steps of a flowchart shown in FIG. 2 when the engine 1 is in one of the open-loop control regions.

$K_{LS}$ is a mixture-leaning coefficient which is set to a predetermined value smaller than 1.0, e.g. 0.95, when the engine 1 is in a mixture-leaning region or a fuel-cut region of the open-loop control regions, i.e., in a predetermined decelerating region.

$K_1$ and $K_2$ are other correction coefficients and correction variables, respectively, calculated on the basis of engine operating parameters by using respective predetermined arithmetic expressions or maps, to such values as optimize operating characteristics of the engine such as fuel consumption and engine accelerability.

The CPU 5b supplies a driving signal to each of the fuel injection valves 6 through the output circuit 5d to open same over the fuel injection period $T_{OUTM}$ calculated as above.

Figure 2A:
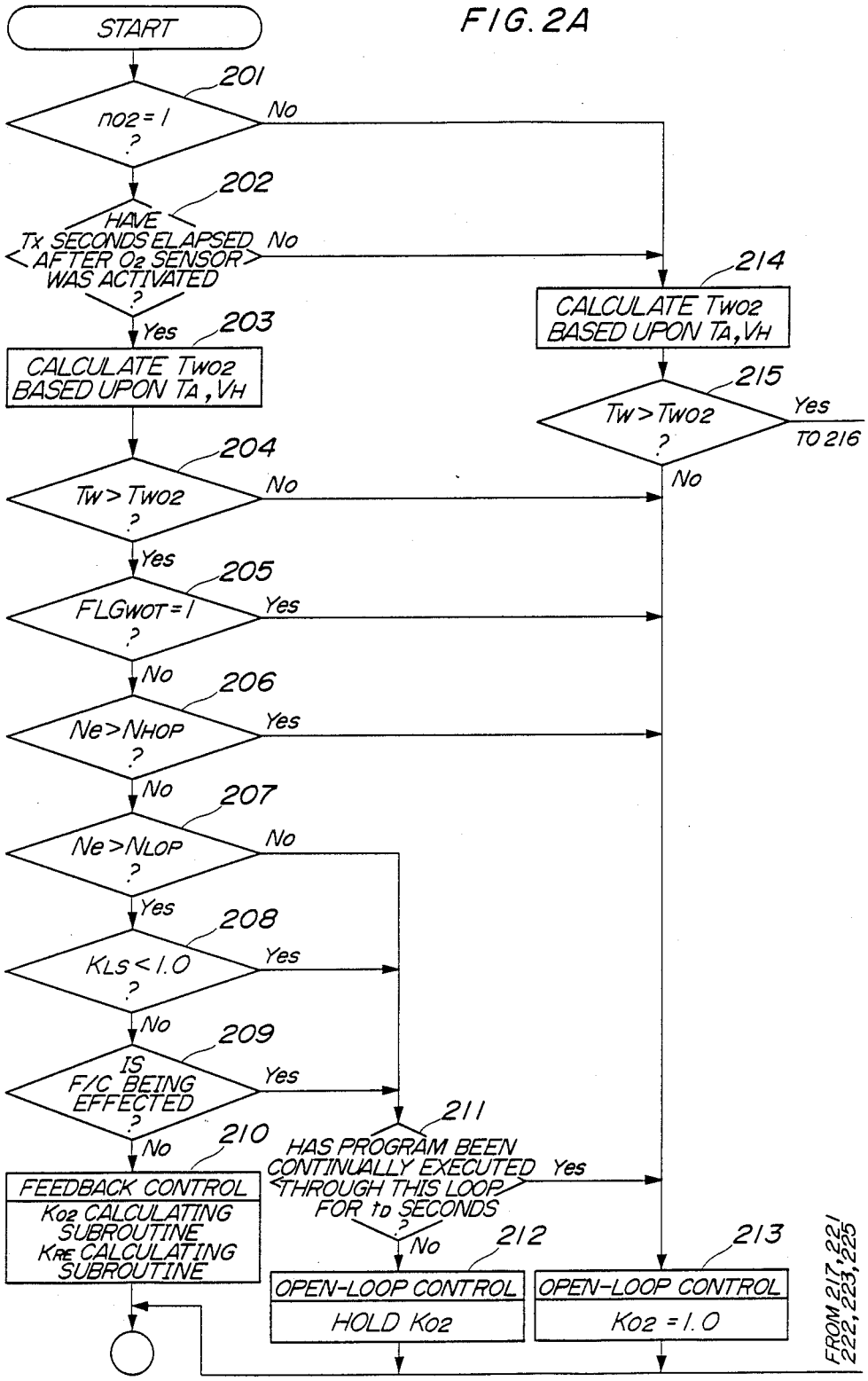
FIGS. 2, 2A and 2B are a flowchart of a control program for determining operating conditions of the engine and setting a correction coefficient $K_{O2}$ based on the determined operating conditions.
Figures 2, 2B:
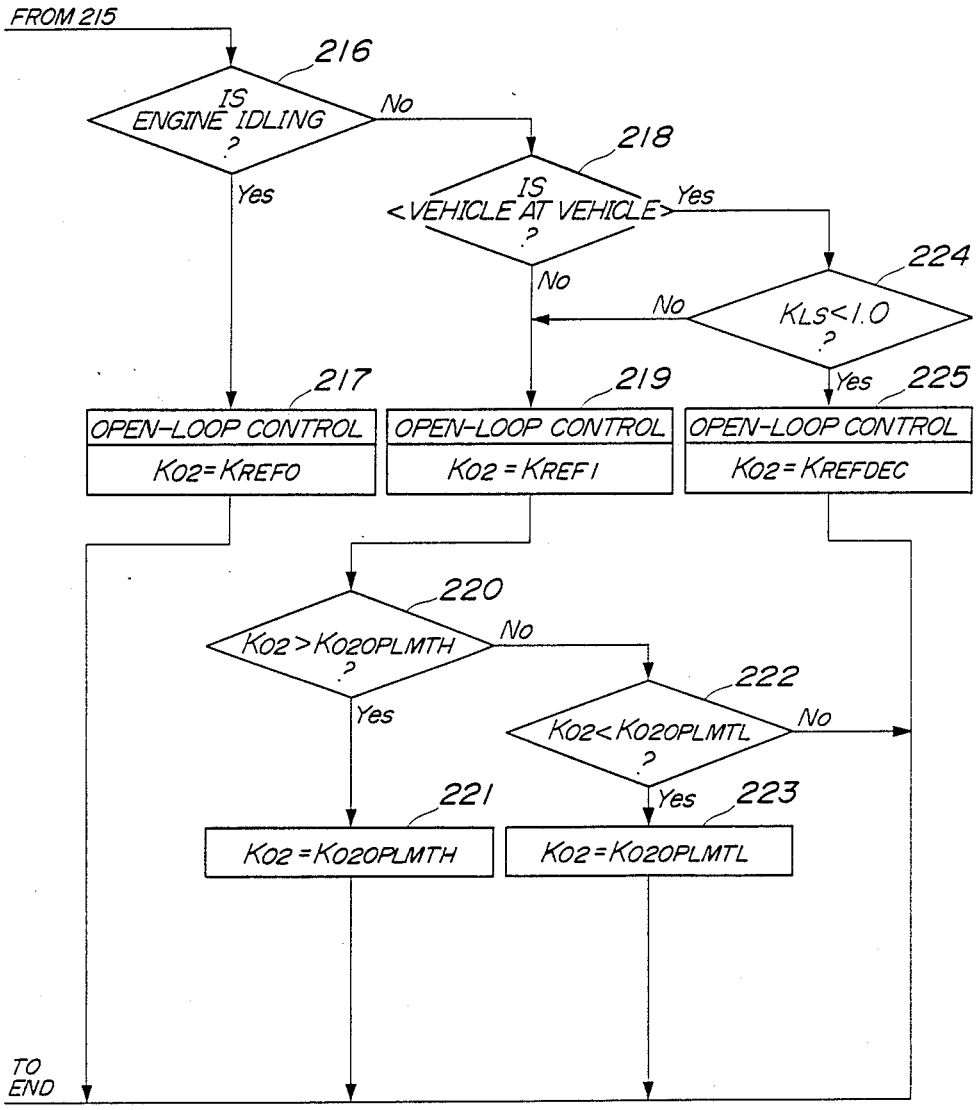

FIG. 2 shows a flowchart of a control program for determining which of the feedback control region and the open-loop control regions the engine is operating in, and setting the correction coefficient $K_{O2}$ in accordance with the determined operating region. The control program is executed upon generation of each pulse of the TDC signal and in synchronism therewith.

First, at a step 201, it is determined whether or not the value of a flag $\eta_{02}$ is equal to 1. The flag $\eta_{02}$ represents whether or not it has been determined that the $O_2$ sensor is in an activated state, which is set to 0 upon initialization of the CPU 56.

Figure 3:
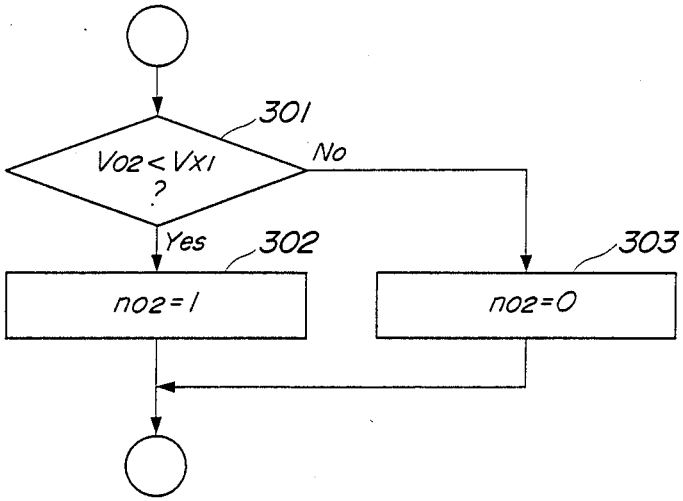
FIG. 3 is a flowchart of a subroutine for determining activation of an $O_2$ sensor.

FIG. 3 shows a subroutine for setting the flag $\eta_{02}$, which is executed upon generation of each pulse of the TDC signal. First, it is determined at a step 301 whether or not an output voltage $V_{02}$ of the $O_2$ sensor 15 is lower than a predetermined value $V_{X1}$, e.g., 0.4 V, for determining the activation of the $O_2$ sensor 15, which is set at a value lower than a reference voltage $V_{REF}$, e.g., 0.5 V, corresponding to a stoichiometric air-fuel ratio. If the answer to the question of the step 301 is affirmative or Yes, that is, if $V_{O2} < V_{X1}$ is satisfied, it is determined that the $O_2$ sensor 15 is in an activated state and the flag $\eta_{O2}$ is set to 1 at a step 302, whereas if the answer is negative or NO, that is, if $V_{O2} \geqq V_{X1}$ is satisfied, it is determined that the $O_2$ sensor 15 is in an inactivated state and the flag $\eta_{O2}$ is set to 0 at a step 303.

Referring again to the control program of FIG. 2, if the answer to the question of the step 201 is affirmative or Yes, that is, if $\eta_{O2}=1$ is satisfied, which means that the $O_2$ sensor 15 has become activated, it is determined at a step 202 whether or not a predetermined time period $t_X$ has elapsed after $\eta_{O2}=1$ become satisfied. If the answer is affirmative or Yes, a pre determined value $T_{WO2}$ of engine coolant temperature is calculated based upon the intake air temperature $T_A$ and the vehicle speed $V_H$ at a step 203, and then it is determined at a step 204 whether or not the detected engine coolant temperature $T_W$ is higher than the predetermined value $T_{WO2}$ calculated as above. If the answer is affirmative or Yes, that is, if the engine 1 has been warmed up, it is determined at a step 205 whether or not the flag $FLG_{WOT}$ is equal to 1. The flag $FLG_{WOT}$ is to be set to 1 by executing a program, not shown, when it is determined that the engine 1 is in a high-load region wherein an increased amount of fuel is supplied to the engine 1.

If the answer to the question of the step 205 is negative or No, that is, if the engine 1 is not in the high-load region, it is determined at a step 206 whether or not the engine rotational speed Ne is higher than a predetermined value $N_{HOP}$ defining a predetermined high rotational-speed region. If the answer is negative or No, it is determined at a step 207 whether or not the engine rotational speed Ne is higher than a predetermined value $N_{LOP}$ defining a predetermined low rotational-speed region. If the answer is affirmative or Yes, that is, if $N_{LOP} < Ne \leqq N_{HOP}$ is satisfied, it is determined at steps 208 and 209 whether or not the engine 1 is in the predetermined decelerating region. That is, it is first determined at a step 208 whether the mixture-leaning coefficient $K_{LS}$ is smaller than 1.0 or not. If the answer to the question of the step 208 is negative or No, it is then determined at a step 209 whether or not fuel cut is being carried out by the engine 1. If the answer is negative or No, it is determined that the engine 1 is in the feedback control region, and the program proceeds to a step 210, wherein the correction coefficient $K_{O2}$ is calculated in response to the output of the $O_2$ sensor 15 in accordance with a subroutine for calculating the correction coefficient $K_{O2}$ shown in FIG. 5, hereinafter described, and average values $K_{REF}$ of the calculated values of the correction coefficient $K_{O2}$ are calculated in accordance with a subroutine for calculating $K_{REF}$ shown in FIG. 6, hereinafter described, followed by terminating the program.

When at least one of the following conditions is satisfied, the program proceeds to a step 211: if the answer to the question of the step 207 is negative or No, i.e., if $Ne \leqq N_{LOP}$ is satisfied and the engine 1 is in the predetermined low rotational-speed region; if the answer to the question of the step 208 is affirmative or Yes, i.e., if the engine 1 is in the predetermined decelerating region; and if the answer to the question of the step 209 is affirmative or Yes, i.e., if fuel cut is being carried out by the engine 1. At the step 211, it is determined whether or not the program has been continually executed through this loop for a predetermined time period $t_D$. If the answer is negative or No, at a step 212 the correction coefficient $K_{O2}$ is held at a value which had been calculated immediately before the program was executed through this loop for the first time, whereas if the answer is affirmative or Yes, the correction coefficient $K_{O2}$ is set to 1.0 at a step 213 for effecting open-loop control, followed by terminating the program. That is, when as a result of the answer to any of the steps 207 to 209, it is determined that the engine 1 has shifted from the feedback control region to the open-loop control region, i.e. the predetermined decelerating condition, the correction coefficient $K_{O2}$ is held at a value, which has been assumed immediately before the shifting, before the predetermined time period $t_D$ elapses after the shifting, but it is set to 1.0 upon lapse of the predetermined time period $t_D$.

When at least one of the following conditions is satisfied, the program proceeds to a step 213: if the answer to the question of the step 204 is negative or No, that is, if the engine 1 has not been warmed up; if the answer to the question of the step 205 is affirmative or Yes, that is, if the engine 1 is operating in the high-load region; and if the answer to the question of the step 206 is affirmative or Yes, that is, if the engine 1 is in the predetermined high rotational-speed region. At the step 213, open-loop control is effected, followed by terminating the program.

If the answer to the question of the step 201 is negative or No, that is, if it is determined that the $O_2$ sensor 15 is in the inactivated state, or if the answer to the question of the step 202 is negative or No, that is, if the predetermined time period $t_X$ has not elapsed after the $O_2$ sensor 15 became activated, steps 214 and 215 are executed just in the same manner as the steps 203 and 204, respectively. If the answer to the question of the step 215 is negative or No, that is, if the engine 1 has not been warmed up, the step 213 is executed, followed by terminating the program.

If the answer to the question of the step 215 is affirmative or Yes, that is, if the engine 1 has been warmed up, it is determined at a step 216 whether or not the engine 1 is in an idling region, by determining whether or not the engine rotational speed Ne is equal to or lower than a predetermined value, and whether or not the throttle valve opening $\theta_{TH}$ is equal to or smaller than a predetermined value, for example. If the answer to the question of the step 216 is affirmative or Yes, that is, if the engine 1 is in the idling region, the correction coefficient $K_{O2}$ is set to an average value $K_{REF0}$ of the correction coefficient $K_{O2}$ for the idling region (hereinafter referred to as "the average value for the idling region"), which is calculated as hereinafter described, at a step 217, for effecting open-loop control, followed by terminating the program.

If the answer to the question of the step 216 is negative or No, that is, if the engine 1 is in a region other than the idling region (hereinafter referred to as "the off-idling region"), it is determined at a step 218 whether or not the vehicle in which the engine 1 is installed is an so-called AT vehicle equipped with an automatic transmission. If the answer is negative or No, that is, if the vehicle is not an AT vehicle, the program proceeds to a step 219, wherein the correction coefficient $K_{O2}$ is set to an average value $K_{REF1}$ of the correction coefficient $K_{O2}$ for the off-idling region (hereinafter referred to as "the average value for the off-idling region), which is calculated as hereinafter described.

At steps 220 et seq., limit checking is carried out for the value of correction coefficient $K_{O2}$ set at the step 219. Specifically, it is determined at the step 220 whether or not the value of the correction coefficient $K_{O2}$ is larger than an upper-limit value $K_{O2OPLMTH}$. If the answer is affirmative or Yes, the value of correction coefficient KO2 is reset to the upper-limit value $K_{O2OPLMTH}$ at a step 221, whereas if the answer is negative or No, it is determined at a step 222 whether or not the value of the correction coefficient $K_{O2}$ is smaller than a lower-limit value $K_{O2OPLMTL}$. If the answer is affirmative or Yes, the value of the correction coefficient $K_{O2}$ is reset to the lower-limit value $K_{O2OPLMTL}$ at a step 223, whereas if the answer is negative or No, the program terminates with the value of the correction coefficient $K_{O2}$ maintained as it is.

If the answer to the question of the step 218 is affirmative or Yes, that is, if the vehicle is an AT vehicle, it is determined at a step 224 whether or not the mixture-leaning coefficient $K_{LS}$ is smaller than 1.0. If the answer is negative or No, that is, if the engine 1 is not in the predetermined decelerating region, the program proceeds to step 219 for executing steps 219 et seq., whereas if the answer is affirmative or Yes, that is, if the engine 1 is in the predetermined decelerating region, the correction coefficient $K_{O2}$ is set to an average value $K_{REFDEC}$ of the correction coefficient $K_{O2}$ for the decelerating region (hereinafter referred to as "the average value for the decelerating region"), at a step 225, which is calculated as hereinafter described, for effecting open-loop control, followed by terminating the program.

Figure 4:
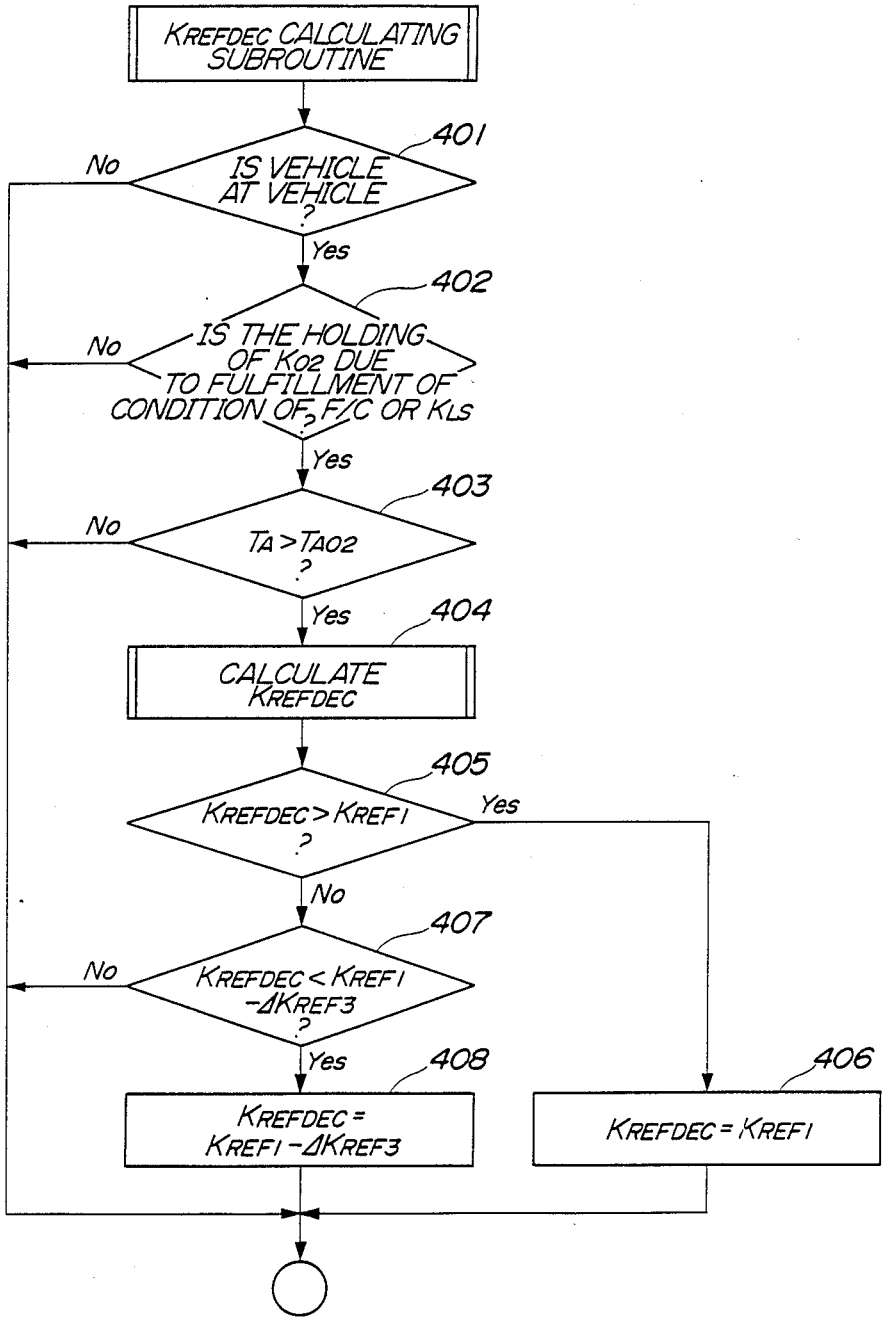
FIG. 4 is a flowchart of a subroutine for calculating an average value $K_{REFDEC}$ for a decelerating region.

FIG. 4 shows a subroutine for calculating the average value $K_{REFDEC}$ for the decelerating region, which is executed only once immediately after the correction coefficient $K_{O2}$ is held for the first time at the step 212 of the control program of FIG. 2.

First, the following respective determinations are made: it is determined at a step 401 whether or not the vehicle is an AT vehicle; it is determined at step 402 whether or not the holding of the correction coefficient $K_{O2}$ is due to fulfillment of the condition of the step 208 or 209 of the control program of FIG. 2; and it is determined at a step 403 whether or not the intake air temperature $T_A$ is higher than a predetermined value $T_{AO2}$, e.g., 20° C. If all the answers are affirmative or Yes, that is, if the vehicle is an AT vehicle, and at the same time the engine 1 is operating in the predetermined decelerating region with the intake air temperature $T_A$ being high, the average value $K_{REFDEC}$ for the decelerating region is calculated by the use of the following equation (2) at a step 404, and the calculated result is stored into the memory unit 5c:

$$K_{REFDEC}=K_{O2HOLD}\cdot(C_{REFDEC}/A)+K_{REFDEC}'\cdot(A-C_{REFDEC})/A \quad (2)$$

where $K_{O2HOLD}$ represents a value of the correction coefficient $K_{O2}$ which has been held at the step 212, A an averaging constant, $C_{REFDEC}$ an averaging variable experimentally obtained, which is set to an appropriate value between 1 and A, and $K_{REFDEC}'$ an average value of values of the correction coefficient $K_{O2}$ obtained so far through past operation of the engine and stored.

Since the ratio of $K_{O2HOLD}$ to $K_{REFDEC}$ varies with the variable $C_{REFDEC}$, an optimum value $K_{REFDEC}$ can be obtained by setting the value $C_{REFDEC}$ to such a value that best suits the type of an air-fuel ratio feedback control system, an engine, etc. to be applied.

Then, limit checking of the average value $K_{REFDEC}$ for the decelerating region calculated at the step 404 is carried out at steps 405 et seq. That is, it is determined at a step 405 whether or not the average value $K_{REFDEC}$ is larger than the average value $K_{REF1}$ for the off-idling region. If the answer is affirmative or Yes, the average value $K_{REFDEC}$ is reset to the average value $K_{REF1}$ at the step 406 to hold the former equal to the latter to prevent that the air-fuel ratio is not leaned due to an excessively large average value $K_{REFDEC}$, whereas if the answer is negative or No, it is determined at a step 407 whether or not the average value $K_{REFDEC}$ is smaller than the difference between the value $K_{REF1}$ and a predetermined value $K_{REF3}$, i.e., $(K_{REF1}-K_{REF3})$. If the answer is affirmative or Yes, the average value $K_{REFDEC}$ is reset to the difference $(K_{REF1}-K_{REF3})$ at a step 408 to prevent excessive leaning of the mixture leading to poor drivability of the engine 1, whereas if the answer is negative or No, the program is terminated with the value $K_{REFDEC}$ maintained as it is.

If at least one of the answers to the questions of the steps 401 to 403 is negative or No, the program is terminated without calculating the average value $K_{REFDEC}$.

Figure 5A:
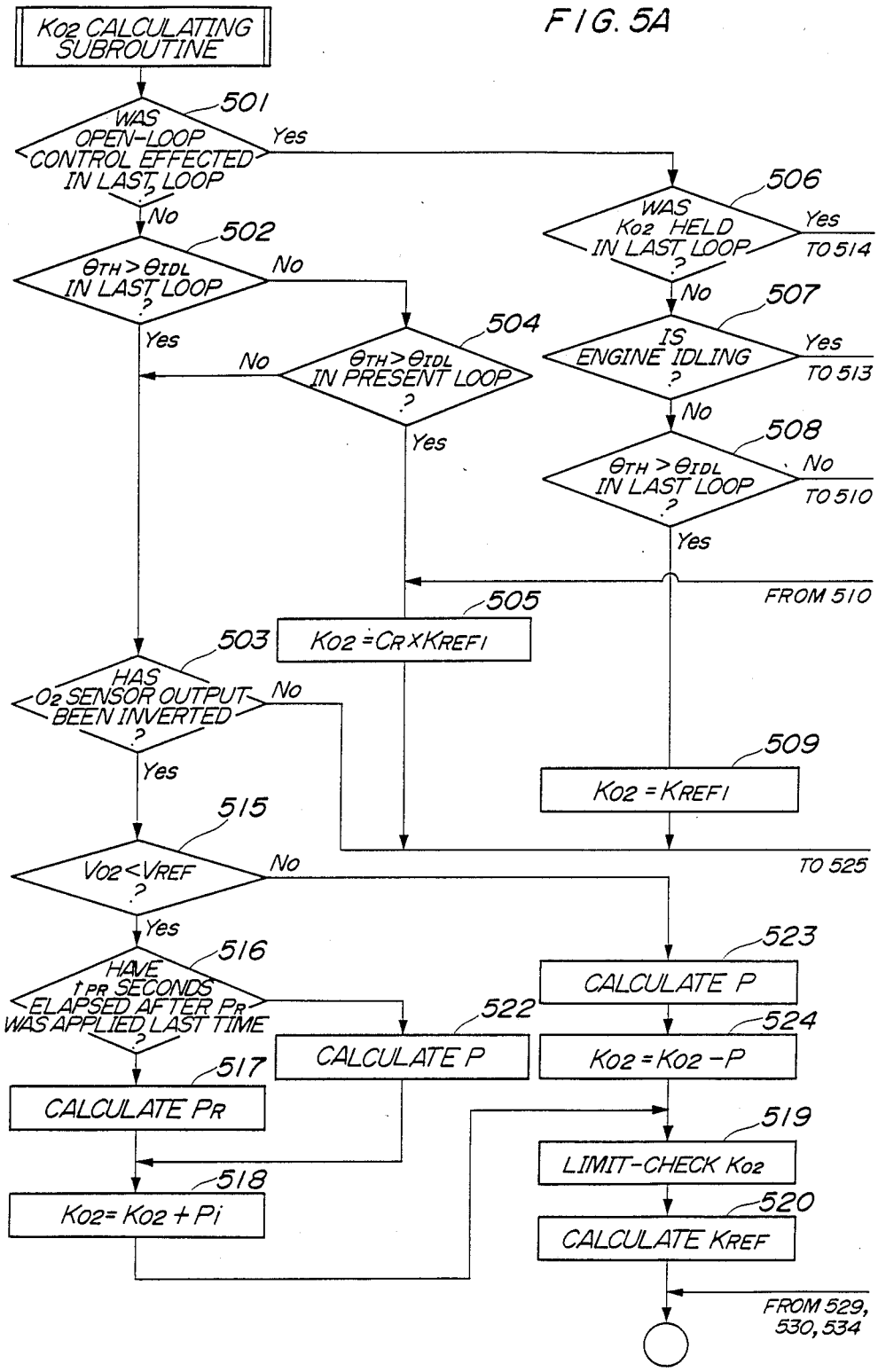
FIGS. 5, 5A and 5B are a flowchart of a subroutine for calculating the correction coefficient $K_{O2}$ when the engine is under feedback control.
Figures 5, 5B:
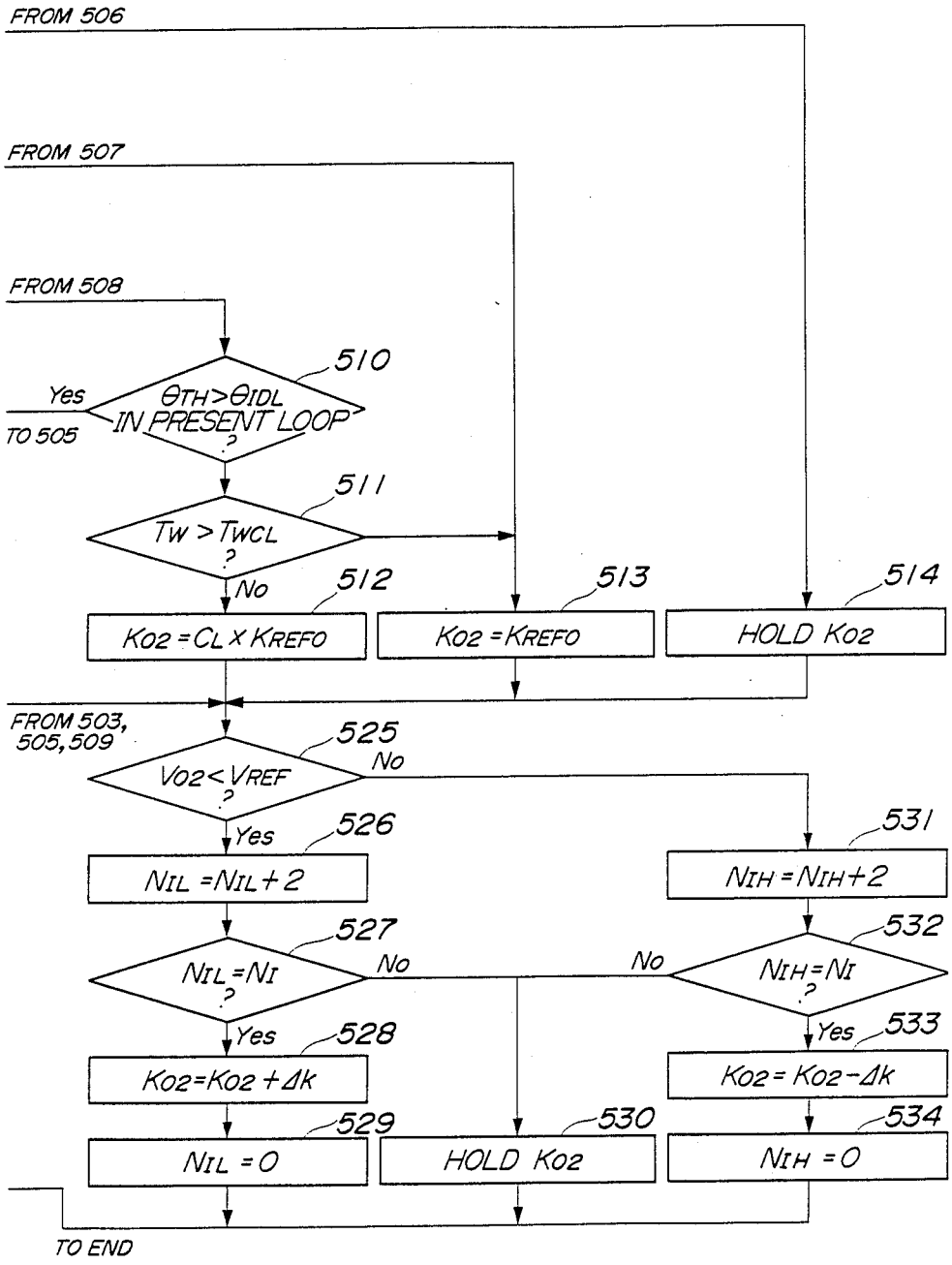

FIG. 5 shows a flowchart of a subroutine for calculating the correction coefficient $K_{O2}$, which is executed at the step 210 of the control program of FIG. 2 during engine operation under the feedback control.

First, it is determined at a step 501 whether or not open-loop control was carried out in the immediately preceding loop. If the answer is affirmative or Yes, it is determined at a step 506 whether or not the correction coefficient $K_{O2}$ has held by executing the step 212 in FIG. 2 in the immediately preceding loop. If the answer is affirmative or Yes, the value of the correction coefficient $K_{O2}$ is held as it is, at a step 514, followed by effecting integral control (I-term control) at steps 525 et seq., hereinafter described.

If the answer to the question of the step 506 is negative or No, that is, if the correction coefficient $K_{O2}$ was not held in the immediately preceding loop, it is determined at a step 507 whether or not the engine 1 is in the idling region. If the answer is affirmative or Yes, that is, if the engine 1 is in the idling region, the correction coefficient $K_{O2}$ is set to the average value $K_{REF0}$ for the idling region at a step 513, followed by effecting integral control by executing the steps 525 et seq.

If the answer to the question of the step 507 is negative or No, that is, if the engine 1 is in the off-idling region, it is determined at a step 508 whether or not the throttle valve opening $\theta_{TH}$ in the immediately preceding loop was larger than a predetermined value $\theta_{IDL}$ defining the idling region. If the answer is affirmative or Yes, the correction coefficient $K_{O2}$ is set to the average value $K_{REF1}$ for the off-idling region at a step 509, followed by effecting the integral control of the steps 525 et seq.

If the answer to the question of the step 508 is negative or No, that is, if $\theta_{TH} \leqq \theta_{IDL}$ was satisfied in the last loop, it is determined at a step 510 whether or not the throttle valve opening $\theta_{TH}$ in the present loop is larger than the predetermined value $\theta_{IDL}$. If the answer is affirmative or Yes, that is, if $\theta_{TH} \leqq \theta_{IDL}$ was satisfied in the last loop and $\theta_{TH} > \theta_{IDL}$ is satisfied in the present loop, the correction coefficient $K_{O2}$ is set to a value of the product of the average value $K_{REF1}$ for the off-idling region and a predetermined mixture-enriching value $C_R$, i.e., $C_R \times K_{REF1}$, at a step 505, followed by effecting the integral control of the steps 525 et seq. The predetermined mixture-enriching value $C_R$ is set at a value larger than 1.0.

If the answer to the question of the step 510 is negative or No, that is, if $\theta_{TH} \leqq \theta_{IDL}$ is satisfied, it is determined at a step 511 whether or not the engine coolant temperature $T_W$ is higher than a predetermined value $T_{WCL}$, e.g., 70° C. If the answer is affirmative or Yes, that is, if $T_W > T_{WCL}$ is satisfied and the engine coolant temperature $T_W$ is not low, the program proceeds to step 513.

If the answer to the question of the step 511 is negative or No, that is, if $T_W \leqq T_{WCL}$ is satisfied and the engine coolant temperature $T_W$ is low, the correction coefficient $K_{O2}$ is set to a value of the product of the average value $K_{REF0}$ for the idling region and a predetermined mixture-leaning value $C_L$, i.e., $C_L \times K_{REF0}$, at a step 512, followed by effecting the integral control of the steps 525 et seq. The predetermined mixture-leaning value $C_L$ is set at a value smaller than 1.0.

If the answer to the question of the step 501 is negative or No, that is, if the feedback control was effected in the last loop, it is determined at a step 502 whether or not the throttle valve opening $\theta_{TH}$ in the last loop was larger than the predetermined value $\theta_{IDL}$. If the answer is negative or No, it is determined at a step 504 whether or not the throttle valve opening $\theta_{TH}$ in the present loop is larger than the predetermined value $\theta_{IDL}$. If the answer is affirmative or Yes, the program proceeds to the step 505, similarly to the case of the answer to the question of the step 510 being affirmative, wherein the correction coefficient $K_{O2}$ is set to a value of the product of the average value $K_{REF1}$ for the off-idling region and the predetermined enrichment value $C_R$, i.e., $C_R \times K_{REF1}$.

If the answer to the question of the step 502 is affirmative or Yes, that is, if $\theta_{TH} > \theta_{IDL}$ was satisfied in the last loop, or if the answer to the question of the step 504 is negative or No, that is, if $\theta_{TH} \leqq \theta_{IDL}$ is satisfied in the present loop, it is determined at a step 503 whether or not the output level of the $O_2$ sensor 15 has been inverted. If the answer is negative or No, the integral control of the steps 525 et seq is effected.

If the answer to the question of the step 503 is affirmative or Yes, that is, if the output level of the $O_2$ sensor has been inverted, proportional control (P-term control) is effected as follows. First, it is determined at a step 515 whether or not the output voltage $V_{O2}$ of the $O_2$ sensor 15 is lower than a reference voltage $V_{REF}$. If the answer is affirmative or Yes, that is, if $V_{O2} < V_{REF}$ is satisfied, it is determined at a step 516 whether or not a predetermined time period $t_{PR}$ has elapsed after a second correction value $P_R$, hereinafter described, was applied last time. This predetermined time period $t_{PR}$ is provided to maintain constant the frequency of application of the second correction value $P_R$ throughout the entire engine rotational speed range. To this end, the time period $t_{PR}$ is set to smaller values as the engine rotational speed Ne becomes higher. If the answer to the question of the step 516 is affirmative or Yes, a value of the second correction value $P_R$ corresponding to the engine rotational speed Ne is read from an Ne-$P_R$ table, at a step 517, whereas if the answer is negative or No, a value of a first correction value P is read from an Ne-P table, at a step 522. Values of the first correction value P within the Ne-P table are smaller than respective corresponding ones of the second correction value $P_R$ within the Ne-$P_R$ table. Then, a correction value $P_i$, i.e., the read first correction value P or the read second correction value $P_R$, is added to the correction coefficient $K_{O2}$, at a step 518. Thus, if the output level of the $O_2$ sensor 15 has been inverted and at the same time the output voltage $V_{O2}$ after invertion is lower than the reference voltage $V_{REF}$, it is judged that the air-fuel ratio has been changed from a rich state to a lean state, and the correction value P or $P_R$ depending on the engine rotational speed Ne is added to the correction coefficient $K_{O2}$ to thereby enrich the air-fuel ratio.

In the meanwhile, if the answer to the question of the step 515 is negative or No, that is, if $V_{O2} \geqq V_{REF}$ is satisfied, similarly to the step 522, a value of the first correction value P corresponding to the engine rotational speed Ne is read from the Ne-P table, at a step 523, and the read first correction value P is subtracted from the correction coefficient $K_{O2}$ at a step 524. Thus, if the output level of the $O_2$ sensor 15 has been inverted and at the same time the output voltage $V_{O2}$ after the invertion is equal to or higher than the reference voltage $V_{REF}$, it is judged that the air-fuel ratio has been changed from a lean state to a rich state, and the correction value P corresponding to the engine rotational speed Ne is subtracted from the correction coefficient $K_{O2}$ to thereby lean the air-fuel ratio.

Then, limit checking of correction coefficient $K_{O2}$ set at the step 528 or 524 is carried out at a step 519. More specifically, it is checked that the calculated value of correction coefficient $K_{O2}$ is within a predetermined range. If the correction coefficient $K_{O2}$ is outside the predetermined range, it is held at the lower or upper limit value of the predetermined range.

Figure 6:
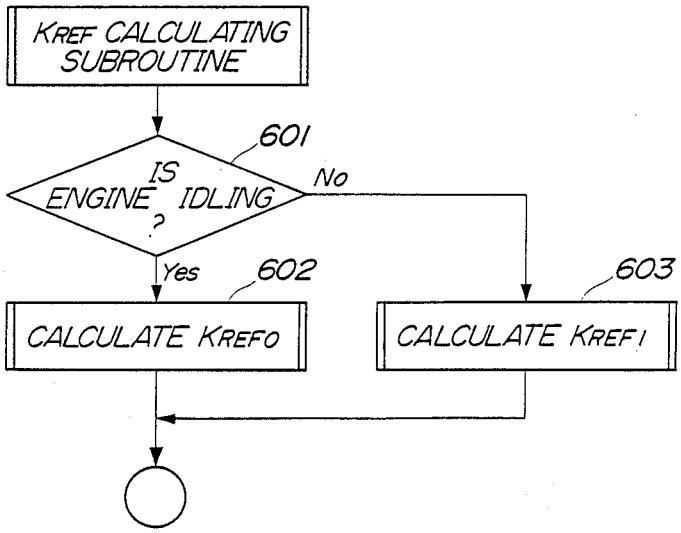
FIG. 6 is a flowchart of a subroutine for calculating respective average values $K_{REF0}$ and $K_{REF1}$ for an idling region and an off-idling region.

An average value $K_{REF}$ is calculated from the values of the correction coefficient $K_{O2}$ thus determined in accordance with a subroutine shown in FIG. 6, at a step 520, and the calculated average value $K_{REF}$ is stored into the memory, followed by terminating the program. Specifically, it is determined at a step 601 whether or not the engine 1 is in the idling region. If the engine 1 is in the idling region, the average value $K_{REF0}$ for the idling region is calculated by the use of the following equation (3), at a step 602, whereas if the engine 1 is in the off-idling region, the average value $K_{REF1}$ is calculated also by the use of the same equation, at a step 603.

$$K_{REFn}=K_{O2P}(C_{REFn}/A_n)+K_{REFn'}\cdot(A_n-C_{REFn})/A_n \quad (3)$$

where $K_{O2P}$ represents a value of $K_{O2}$ obtained immediately after execution of the proportional control (P-term control), $A_n$ and $C_{REFn}$ are averaging constant value and variables, respectively, similar to the aforementioned A and $C_{REFDEC}$, and set for each engine operating region, and $K_{REFn'}$ represents an average value of values of $K_{REF}$ obtained so far through past operation of the engine and stored in the same engine operating region as that in the present loop.

Referring again to FIG. 5, the integral control of the steps 525 et seq. will be described. First, it is determined at the step 525 whether or not the output voltage $V_{O2}$ of the $O_2$ sensor 15 is lower than the aforementioned reference voltage $V_{REF}$. If the answer is affirmative or Yes, that is, if $V_{O2}<V_{REF}$ is satisfied, a value of 2 is added to $N_{IL}$, a counted number of pulses of the TDC signal, at a step 526, and it is determined at a step 527 whether or not the counted pulse number $N_{IL}$ has reached a predetermined value $N_I$. If the answer is negative or No, the correction coefficient $K_{O2}$ is held at an immediately preceding value at a step 530, while if the answer is affirmative or Yes, a predetermined value $\Delta k$ is added to the correction coefficient $K_{O2}$ at a step 528, and the counted pulse number $N_{IL}$ is reset to 0 at a step 529. In this way, whenever the counted pulse number NIL reaches the predetermined value $N_I$, the correction coefficient $K_{O2}$ is increased by the predetermined value $\Delta k$.

Thus, so long as the state in which the output voltage $V_{O2}$ of the $O_2$ sensor 15 is lower than the reference voltage $V_{REF}$, that is, the state in which the air-fuel ratio is lean continues, the correction coefficient $K_{O2}$ is increased by the predetermined value $\Delta k$ whenever the counted pulse number $N_{IL}$ reaches the predetermined value $N_I$ to thereby enrich the air-fuel ratio.

On the other hand, if the answer to the question of the step 525 is negative or No, that is, if $V_{O2}\geqq V_{REF}$ is satisfied, a value of 2 is added to a counted number $N_{IH}$ of pulses of the TDC signal, at a step 531, whenever the present step is executed, and it is determined at a step 532 whether or not the counted pulse number $N_{IH}$ has reached the predetermined value $N_I$. If the answer is negative or No, the correction coefficient $K_{O2}$ is held at an immediately preceding value at a step 530, while if the answer is affirmative or Yes, the predetermined value $\Delta k$ is subtracted from the correction coefficient KO2 at a step 533, and the counted pulse number $N_{IH}$ is reset to 0 at a step 534. In this way, whenever the counted pulse number $N_{IH}$ reaches the predetermined value $N_I$, the correction coefficient $K_{O2}$ is decreased by the predetermined value $\Delta k$.

Thus, so long as the state in which the output voltage $V_{O2}$ is equal to or higher than the reference voltage $V_{REF}$, that is, the state in which the air-fuel ratio is rich continues, the correction coefficient $K_{O2}$ is decreased by the predetermined value $\Delta k$ whenever the counted pulse number $N_{IH}$ reaches the predetermined value $N_I$ to thereby lean the air-fuel ratio.

As described above, according to the method of the invention, it is first determined in which region the engine 1 is operating, and then the correction coefficient $K_{O2}$ is set to a value suited to the region thus determined.

Figure 7:
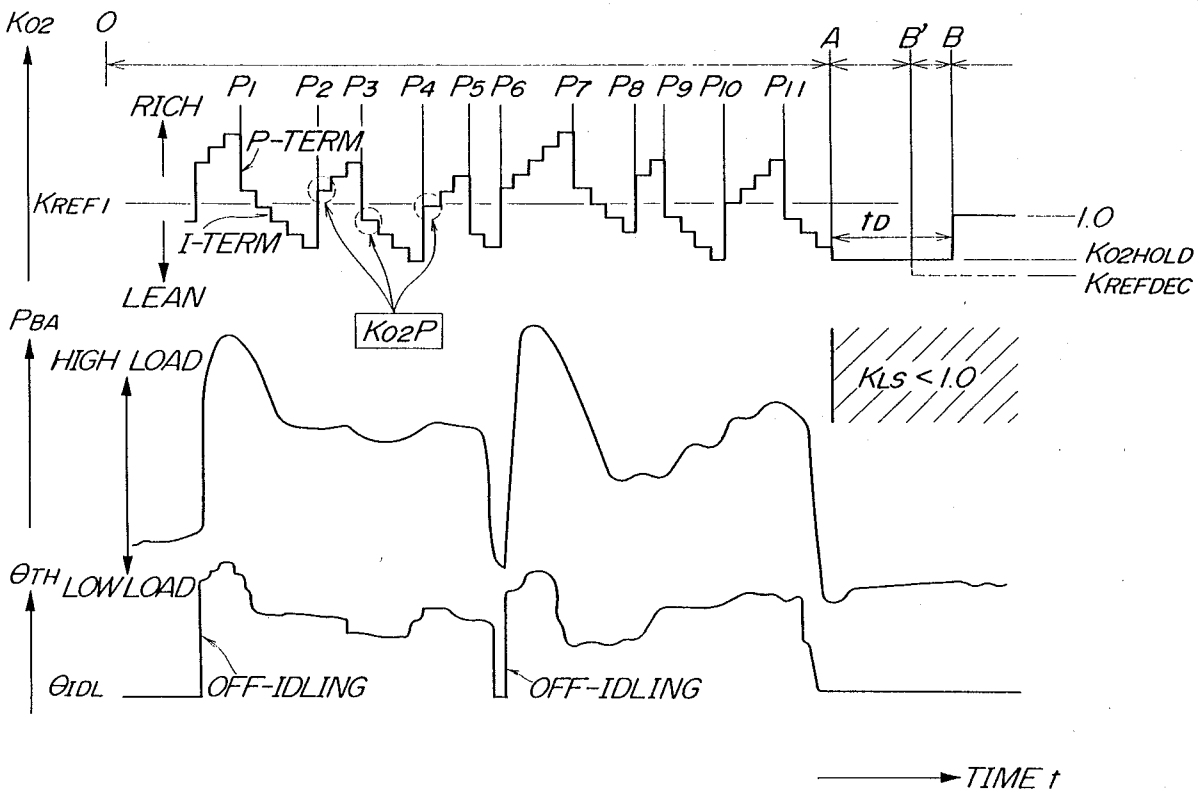
FIG. 7 is a graph showing a manner in which the correction coefficient $K_{O2}$ varies in value with change in the operating state of the engine.

For example, when the engine 1 is in an idling state or a normal operating state, it is determined that the engine 1 is in the feedback control region, e.g., during a time period O-A in FIG. 7, wherein the proportional control (P-term control) is carried out when the output voltage level $V_{O2}$ of the $O_2$ sensor 15 is inverted with respect to the reference voltage $V_{REF}$, at time points $P_1$, $P_2$, etc. in FIG. 7, and the integral control (I-term control) is carried out at predetermined time intervals when the output voltage level $V_{O2}$ is not inverted with respect to the reference voltage $V_{REF}$.

On the other hand, when the throttle valve 3' is closed and the engine 1 shifts from the normal operating state to the predetermined decelerating state, the answer to the question of the step 208 in FIG. 2 is rendered affirmative or Yes, because of $K_{LS}<1.0$ being satisfied, so that the engine shifts from the feedback control region to the open-loop control region, e.g., at a time point A in FIG. 7. On this occasion, the correction coefficient $K_{O2}$ is held at a value $K_{O2HOLD}$, which has been assumed immediately before the shifting, before lapse of the predetermined time period $t_D$ from the shifting, e.g., during a time period A-B in FIG. 7, but it is set to and held at a value 1.0 upon and after lapse of the predetermined time period $t_D$, e.g., at a time point B and thereafter in FIG. 7. Thus, these respective values of the correction coefficient $K_{O2}$ are applied to the equation (1), together with the mixture-leaning coefficient $K_{LS}$ to thereby lean the air-fuel ratio.

The above value $K_{O2HOLD}$ of the correction coefficient $K_{O2}$ is a value assumed immediately before the engine 1 shifts from the feedback control region to the open-loop control region, i.e., immediately before the feedback control is interrupted upon shifting of the engine 1 to the decelerating region. As shown in FIG. 7, the value $K_{O2HOLD}$ is calculated to such a value as to lean the mixture or the air-fuel ratio, for compensating for the overriching of the mixture caused by supply of fuel adhering to the inner wall of the intake pipe into the engine cylinders due to lowering of the intake pipe absolute pressure $P_{BA}$. Consequently, by applying the value $K_{O2HOLD}$ as a correction coefficient $K_{O2}$ value to equation (1) together with the mixture-leaning coefficient $K_{LS}$ during the predetermined time period $t_D$, to thereby lean the air-fuel ratio.

During the decelerating state of the engine 1, in the case where there is a substantially large amount of fuel adhering to the intake pipe or in the case where the basic fuel injection period Ti is deviated toward a larger value, which is attributable to manufacturing variations between individual control systems and/or individual detection systems, aging in these systems, etc., if the value of the correction coefficient $K_{O2}$ set as above as well as the mixture-leaning coefficient $K_{LS}$ having a fixed value are applied to the equation (1), the air-fuel ratio can be controlled toward a richer value so that the answer to the question of the step 301 in the subroutine of FIG. 3 is rendered negative or No, thereby temporarily impeding determination as to the activation of the $O_2$ sensor 15. On such an occasion, according to the method of the invention, the answer to the question of the step 201 in FIG. 2 is rendered negative or No, so that the correction coefficient $K_{O2}$ continues to be set to the average value $K_{REFDEC}$ for the decelerating region at the step 225 in FIG. 2, so long as the engine 1 stays in the decelerating region, e.g., at and after a time point B' in FIG. 7. The average value $K_{REFDEC}$ is calculated solely from values of the value $K_{O2HOLD}$, i.e., values of the correction coefficient $K_{O2}$ obtained immediately before the feedback control is interrupted upon shifting of the engine 1 to the decelerating region. Consequently, the average value $K_{REFDEC}$ is smaller than 1.0, which reflects a particular operating condition of the engine 1 in the feedback control region immediately before shifting of the engine 1 to the predetermined decelerating region, thereby properly compensating for a variation in the air-fuel ratio characteristic due to manufacturing variations, etc. This result cannot be obtained merely by multiplying the average value $K_{REF1}$ for the off-idling region by a predetermined leaning value.

Therefore, according to the invention, the actual air-fuel ratio can be positively leaned to such a proper value as enables accurate determination of the activation of the $O_2$ sensor 15 during the decelerating condition of the engine in accordance with the air-fuel ratio characteristic of the individual engine applied, merely by applying the average value $K_{REFDEC}$ to the equation (1) together with the mixture-leaning coefficient $K_{LS}$.

What is claimed is:

1. A method of determining the activation of an exaust gas ingredient-concentration sensor for use in an internal combustion engine having an exhaust system in which said sensor is arranged, wherein the air-fuel ratio of a mixture being supplied to said engine is controlled in a feedback manner by the use of a coefficient varying with an output of said sensor during operation of said engine in an air-fuel ratio feedback control region, and the activation of said sensor is determined based on said output of said sensor, the method comprising the steps of:

(1) determining whether or not said engine has shifted from said air-fuel ratio feedback control region to a predetermined decelerating region;

(2) when it is determined that said engine has shifted from said air-fuel ratio feedback control region to said predetermined decelerating region, calculating an average value of values of said coefficient obtained by the feedback control immediately before said shifting;

(3) leaning the air-fuel ratio of said mixture by the use of said average value thus calculated; and (4) determining whether or not said sensor is activated when the air-fuel ratio has thus been leaned.

2. A method as claimed in claim 1, wherein said predetermined decelerating region includes a mixture-leaning region.

3. A method as claimed in claim 1 or claim 2, wherein said predetermined decelerating region includes a fuel-cut region.

4. A method as claimed in claim 1, wherein said step (2) comprises holding a value of said coefficient obtained by the feedback control immediately before said shifting for a predetermined time period after said shifting, and calculating said average value based on said held value.

5. A method as claimed in claim 1 or claim 4, wherein said step (3) comprises leaning said mixture by the use of said average value of said coefficient together with a second coefficient exclusive for leaning the mixture.

6. A method as claimed in claim 1, wherein said calculation of said average value in said step (3) is effected when intake air temperature in said engine is higher than a predetermined value.

7. A method as claimed in claim 1, wherein said engine is equipped with an automatic transmission.

8. A method as claimed in claim 1, including determining whether or not said average value of said coefficient calculated in said step (2) is larger than a second average value of said coefficient calculated in a region other than an idling region, falling within said air-fuel ratio feedback control region, and applying the latter in place of the former in said step (3) when it is determined that the former is larger than the latter.

9. A method as claimed in claim 1, including determining whether or not said average value of said coefficient calculated in said step (2) is smaller than a difference between a second average value of said coefficient calculated in a region other than an idling region, falling within said air-fuel ratio feedback control region and a predetermined value, and applying the latter in place of the former in said step (3) when it is determined that the former is smaller than the latter.

* * * * *